US010246304B2

(12) United States Patent
Ahoniemi et al.

(10) Patent No.: US 10,246,304 B2
(45) Date of Patent: Apr. 2, 2019

(54) INSTALLATION ARRANGEMENT FOR AN ELEVATOR

(71) Applicants: Jarmo Ahoniemi, Jokela (FI); Osmo Björni, Hyvinkaa (FI)

(72) Inventors: Jarmo Ahoniemi, Jokela (FI); Osmo Björni, Hyvinkaa (FI)

(73) Assignee: Kone Corporation, Helsinki (FI)

( * ) Notice: Subject to any disclaimer, the term of this patent is extended or adjusted under 35 U.S.C. 154(b) by 687 days.

(21) Appl. No.: 14/857,022

(22) Filed: Sep. 17, 2015

(65) Prior Publication Data

US 2016/0016759 A1 Jan. 21, 2016

Related U.S. Application Data

(63) Continuation of application No. PCT/FI2014/050180, filed on Mar. 13, 2014.

(30) Foreign Application Priority Data

Mar. 20, 2013 (FI) ..... 20135268

(51) Int. Cl.
*B66B 19/00* (2006.01)
*B66B 7/06* (2006.01)

(52) U.S. Cl.
CPC ..... *B66B 19/00* (2013.01); *B66B 7/062* (2013.01)

(58) Field of Classification Search
CPC ..... B66B 19/00; B66B 19/02; B66B 10/04; B66B 19/007; B66B 7/00; B66B 7/027; B66B 17/02
See application file for complete search history.

(56) References Cited

U.S. PATENT DOCUMENTS 5,065,843 A 11/1991 Richards
2008/0116014 A1* 5/2008 Ach ..... B66B 7/062 187/252

(Continued)

FOREIGN PATENT DOCUMENTS

EP 0699620 A1 3/1996
EP 1669315 A1 6/2006

(Continued)

OTHER PUBLICATIONS

English Machine Translation EP1669315.*

(Continued)

*Primary Examiner* — Diem M Tran
(74) *Attorney, Agent, or Firm* — Harness, Dickey & Pierce, P.L.C.

(57) ABSTRACT

The object of the invention is an installation arrangement for an elevator in an elevator hoistway, which installation arrangement comprises at least a suspension member aligned downwards from the top part of the elevator hoistway, in connection with which suspension member is, at least during the installation of the elevator car, an installation hoist arranged to move while supported by the suspension member, and in which installation arrangement at least the guide rails of the elevator and the elevator car traveling guided by the guide rails are installed in the elevator hoistway. An auxiliary hoist provided with a hoisting means is fitted onto the suspension member, which auxiliary hoist is arranged to move reciprocally in the vertical direction along the suspension member.

17 Claims, 6 Drawing Sheets

(56) References Cited

U.S. PATENT DOCUMENTS

Figure 1:
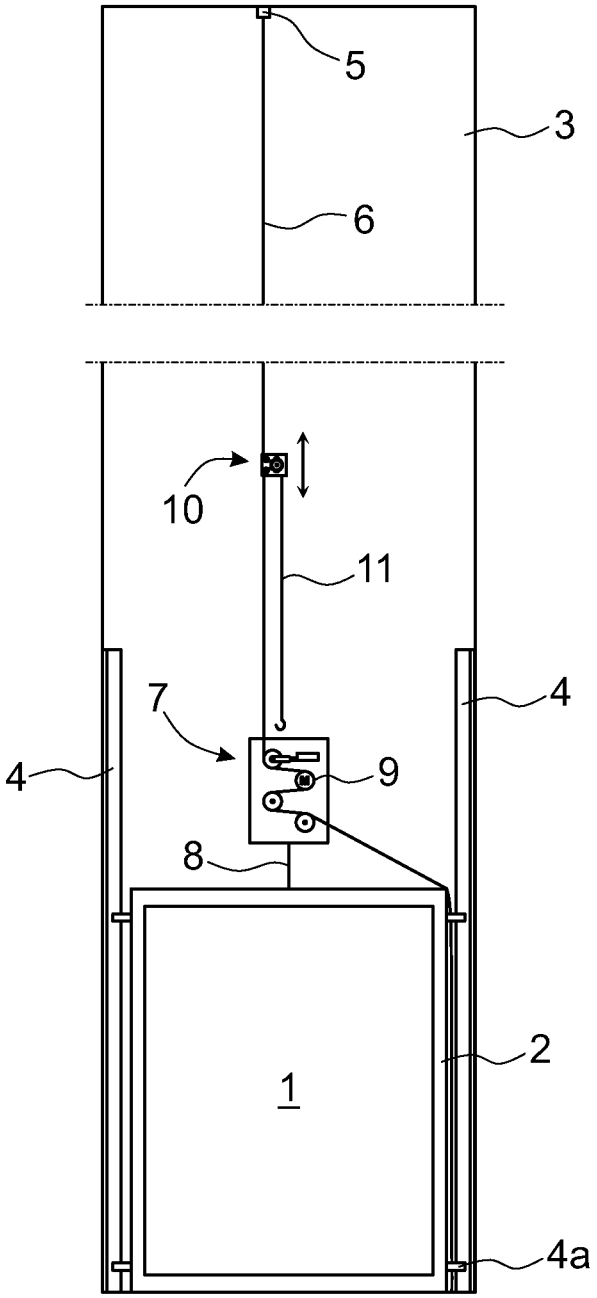

| | | | | |
|---|---|---|---|---|
| 2008/0308362 | A1* | 12/2008 | Tucker | B66B 19/00 187/414 |
| 2016/0060078 | A1* | 3/2016 | Mertala | B66B 19/002 52/741.1 |

FOREIGN PATENT DOCUMENTS

| | | | |
|---|---|---|---|
| JP | S55130473 | A | 10/1980 |
| JP | 3435711 | B2 | 8/2003 |
| JP | 2007230665 | A | 9/2007 |
| JP | 2011068458 | A | 4/2011 |
| WO | WO-2007118928 | A1 | 10/2007 |
| WO | WO-2007128859 | A1 | 11/2007 |
| WO | WO-2010136636 | A1 | 12/2010 |

OTHER PUBLICATIONS

English Machine Translation JPS 55-130473.*
International Search Report PCT/ISA/210 for International Application No. PCT/FI2014/05018 dated Jun. 19, 2014.
Written Opinion of the International Searching Authority PCT/ISA/237 for International Application No. PCT/FI2014/050180 dated Jun. 19, 2014.
Finish Search Report for Application No. 20135268 dated Jan. 1, 2014.
Extended European Search Report dated Feb. 27, 2017 for EP Application No. 14768821.2.

* cited by examiner

INSTALLATION ARRANGEMENT FOR AN ELEVATOR

This application is a continuation of PCT International Application No. PCT/FI2014/050180 which has an International filing date of Mar. 13, 2014, and which claims priority to Finnish patent application number 20135268 filed Mar. 20, 2013, the entire contents of both of which are incorporated herein by reference.

The object of the invention is an installation arrangement for an elevator.

Usually when installing an elevator, in the starting phase of the installation the lowermost sections of the guide rails of the elevator are fixed e.g. to the walls of the elevator hoistway, and the elevator car and car sling are assembled and fitted onto these starting ends of the guide rails from the base of the hoistway. After this, the elevator car is connected to an installation hoist. One generally used installation hoist is a rope hoist, which comprises a hoisting machine provided with a traction sheave and also a hoisting rope. The hoisting machine is fixed e.g. to the top part of the car sling and the hoisting rope is arranged to travel through the machine and passing around the traction sheave. The hoisting machine also comprises the necessary diverting pulleys, so that the hoisting rope can be made to pass around the traction sheave suitably so that large enough friction is produced between the traction sheave and the hoisting rope to enable lifting of the elevator car. From the hoisting machine the hoisting rope is lead e.g. to pass over a diverting pulley fixed to the roof of the elevator hoistway back to the elevator car, where the second end of the hoisting rope is fixed to the top part of the car sling.

When the elevator car has been assembled and has been fitted onto the starting ends of the guide rails, the car can be moved with the installation hoist along the guide rails upwards and downwards. The next sections of the guide rails can, for example, be installed next as extensions to the guide rails that have already been installed. The elevator car is lifted by means of the installation hoist along the sections of the guide rails that have already been installed to a suitable height, after which the elevator car is locked into its position e.g. by means of the safety gear and a safety chain. When the elevator car is locked, the second end of the hoisting rope is detached from the car, the next sections of the guide rails are lifted to the correct height by means of the installation hoist and from the roof of the elevator car are fixed to the walls of the hoistway as extensions to the sections of the guide rails that have already been installed. Then the second end of the hoisting rope is again fixed to the car sling, the locking of the car is removed and the car is again lifted higher in the hoistway and the car is locked into a new position, after which the second end of the hoisting rope is detached from the car and the next sections of the guide rails are lifted with the installation hoist to the correct height and from the roof of the car are fixed to the walls of the hoistway. This procedure is continued until the guide rails are installed in their entirety onto the walls of the elevator hoistway right up to the top part of the hoistway.

The sections of the guide rails to be installed can be transported up along with the elevator car, e.g. fastened to the sides of the car, in which case the sections of the guide rails do not need to be lifted into their positions from the base of the hoistway, but instead from the sides of the car. Also other parts of the elevator can be transported up in the hoistway along with the elevator car by means of the installation hoist and can be installed into their positions from the roof of the car. In this case the installation hoist is again used as a material hoist by first locking the elevator car into its position, by detaching the second end of the hoisting rope from the car, and by lifting the part to be installed into its position by means of the installation hoist in the same manner as when installing the guide rails. For example, in an elevator having a hoisting machine disposed in the top part of the hoistway, the machine can be installed in this manner.

One problem in the installation arrangement described in the preceding is that generally this type of installation hoist, being based on rope friction, is structurally rather heavy-weight and large in size.

Another problem is that the elevator car must be locked into its position and the second end of the hoisting rope must be detached from the car sling for the period during which the other parts of the elevator are lifted with the installation hoist. When it is desired to move the car again, the second end of the hoisting rope must be refastened to the car sling and the locking of the elevator car must be removed. This is repeated many times during installation and takes a lot of time.

The problem described above can be solved by using separate hoists for moving the car and for lifting the other parts of the elevator. The second hoist, to be used as a material hoist, can be e.g. a chain hoist fastened to the roof of the elevator hoistway. A problem in this type of use of a hoist is, however, that in it must be a hoisting chain or corresponding that is essentially the size of the whole hoistway, which chain will be heavy and take up space in the hoistway and can also cause safety risks. This type of separate material hoist, with its separate control means, also incurs extra costs. In addition, a separate material hoist is, in this type of solution, situated a long way from the installation position, except for a situation wherein parts are installed in the top part of the hoistway.

The aim of this invention is to eliminate the aforementioned drawbacks and to achieve a simple and inexpensive installation arrangement for an elevator, by means of which the different parts of an elevator can be installed into the elevator hoistway more quickly and safely than before. The installation arrangement, for an elevator is characterized by what is disclosed in the claims.

In the invention a separate auxiliary hoist is arranged, at least during the moving, on a supporting suspension member, such as on a rope, belt or chain, of the installation hoist intended to move an elevator car or an erecting stage in the elevator hoistway. The auxiliary hoist is configured to move in the upward direction and downward direction along the suspension member.

Some inventive embodiments are also discussed in the descriptive section of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment of the invention can also be applied in other embodiments. In addition it can be stated that at least some of the subordinate claims can in at least suitable situations be deemed to be inventive in their own right.

It is characteristic to some installation arrangements according to the invention that instead of a structure based on rope friction a suspension member structure based on shape-locking, e.g. a toothed belt or a chain, is used along which a separate auxiliary hoist for different lifts of material could be configured to move reciprocally.

A hoist comprising a drive device to be fastened to a suspension member supporting the elevator car is a preferred solution for use as an auxiliary hoist in the invention. In this type of preferred solution the suspension member supporting the elevator car continues in the elevator hoistway both to above the auxiliary hoist and to below the auxiliary hoist and the auxiliary hoist takes a grip on the suspension member, with a traction sheave or with another actuator part and/or gripping part, said grip supporting the auxiliary hoist itself and the load suspended from it.

An advantage of the installation arrangement for an elevator according to the invention is that the suspension member supporting the elevator car does not need to be detached from the car during installation. From this follows the advantage that the car does not need to be secured, i.e. locked, e.g. by means of the safety gear, to the guide rails and fixed to a safety chain when the hoist is detached from the car. As a result of the aforementioned advantages, installation is significantly speeded up. Another advantage is that installation is safer than before. A further advantage is that the installation hoist is more lightweight than before and takes less space, because heavy structures based on friction are not needed.

With the invention a simple and space-saving placement of the installation hoists at the installation site is achieved when both the installation hoist and the auxiliary hoist are fitted onto the same suspension member and the traction sheave of both hoists is arranged to move the hoists along the suspension member.

Preferably the suspension member is a toothed belt. A toothed belt is rather lightweight with respect to its load-bearing capability. The tooth shape of the toothed belt is selected to be suitable according to controllability and load-bearing capability.

A V-belt, i.e. a belt that is V-shaped on the contact surface of the traction sheave, e.g. a trapezoid belt or a Poly-V belt, can also be used as a suspension means. V-shaped in this context does not mean that the tip of the shape of the cross-section is necessarily sharp. With a V-shape contact between the traction sheave and the suspension means based on friction with a rather good grip is achieved.

Even if the installation hoist and the auxiliary hoist were configured to correspond to the same part or surface of the suspension member on their own traction sheave, the load would nevertheless be local on the belt. The auxiliary hoist can also move in relation to the position of the installation hoist. In this way both hoists can be separately used at the same time.

Preferably the hoisting means of the auxiliary hoist, which means suspends the load to be lifted with the auxiliary hoist from the auxiliary hoist, is adjustable in length or is replaceable according to different hoisting purposes.

Figure 2:
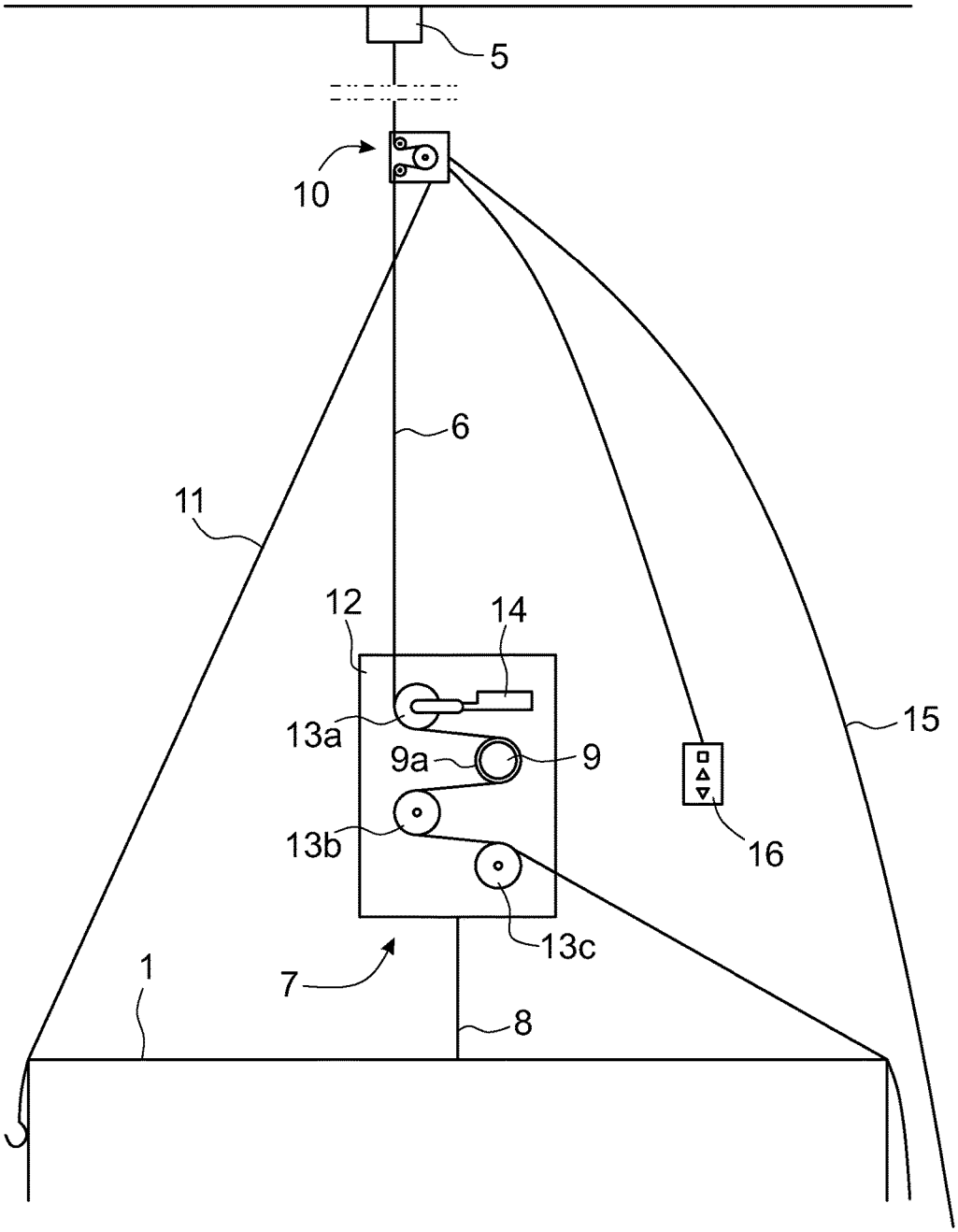
Figure 3:
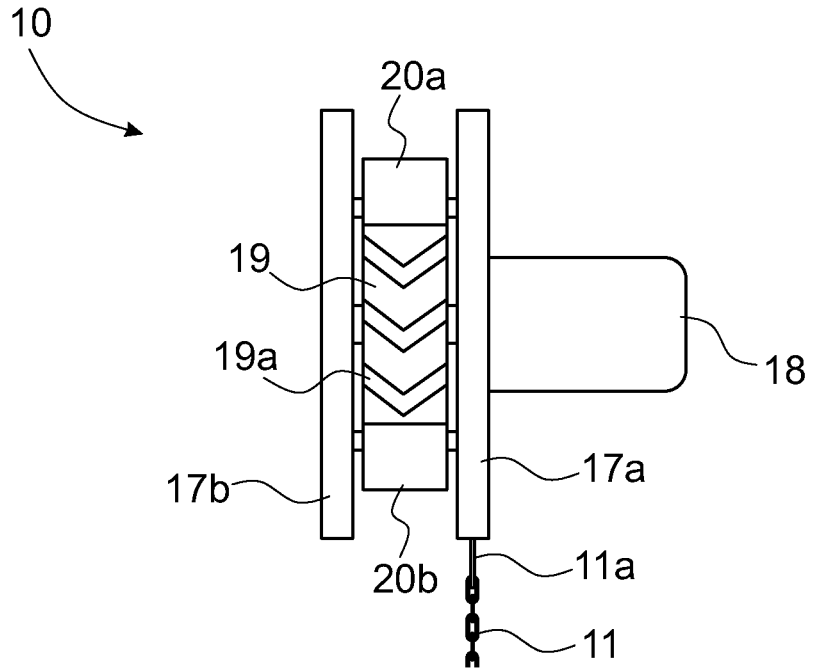
Figure 4:
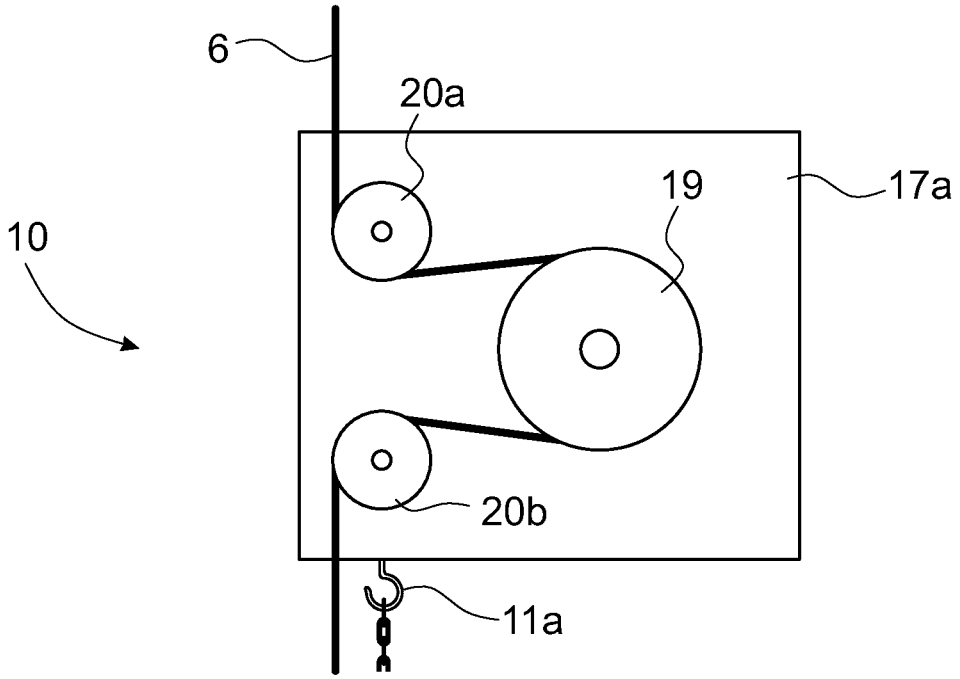
Figure 5:
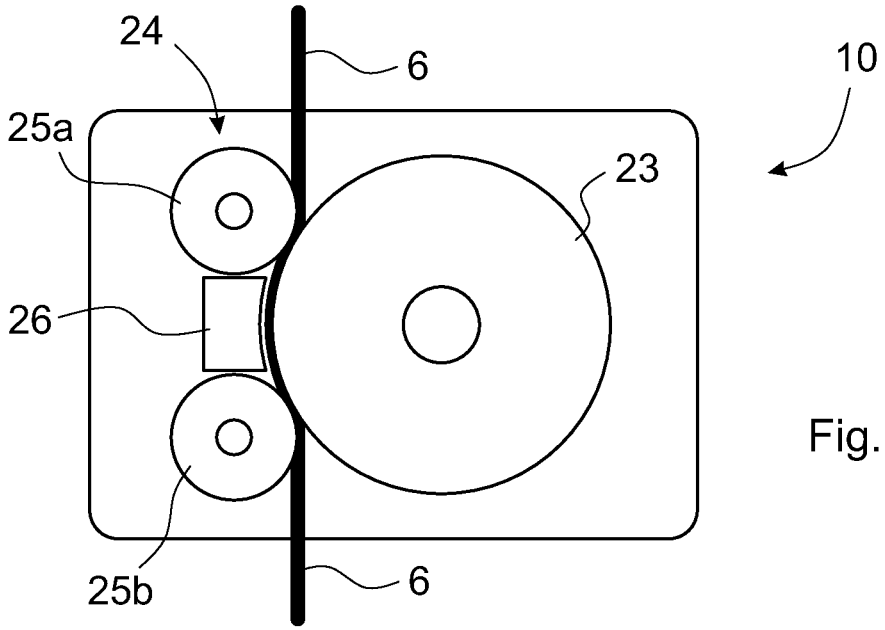
Figure 6:
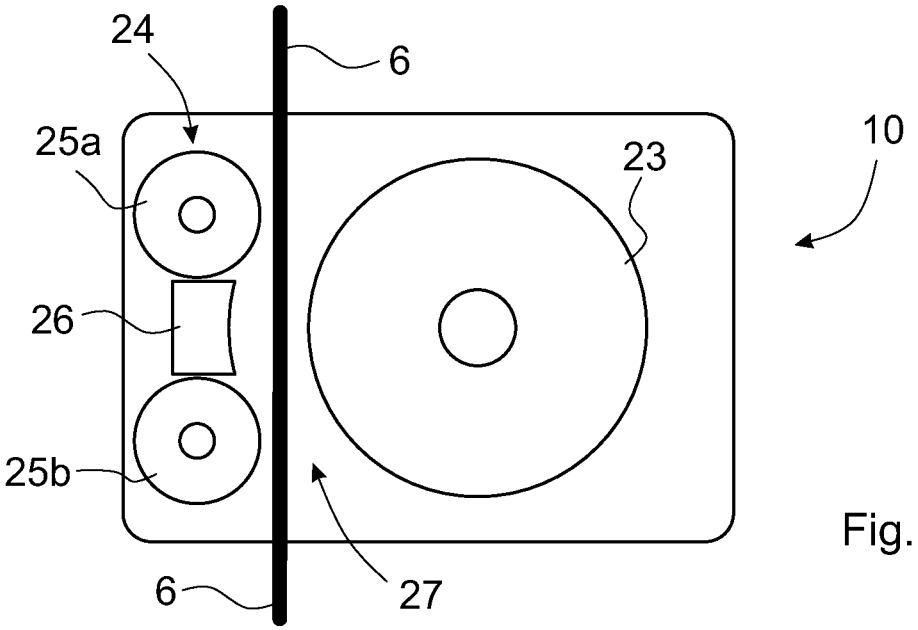
Figure 7:
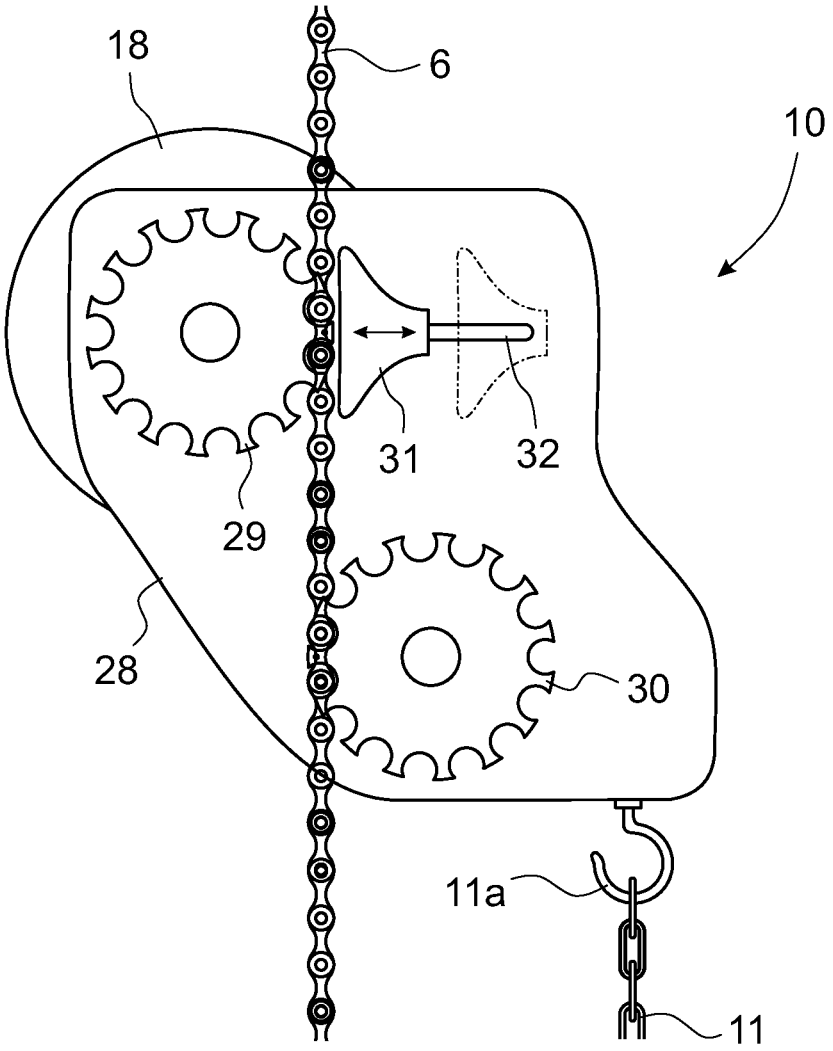
Figure 8:
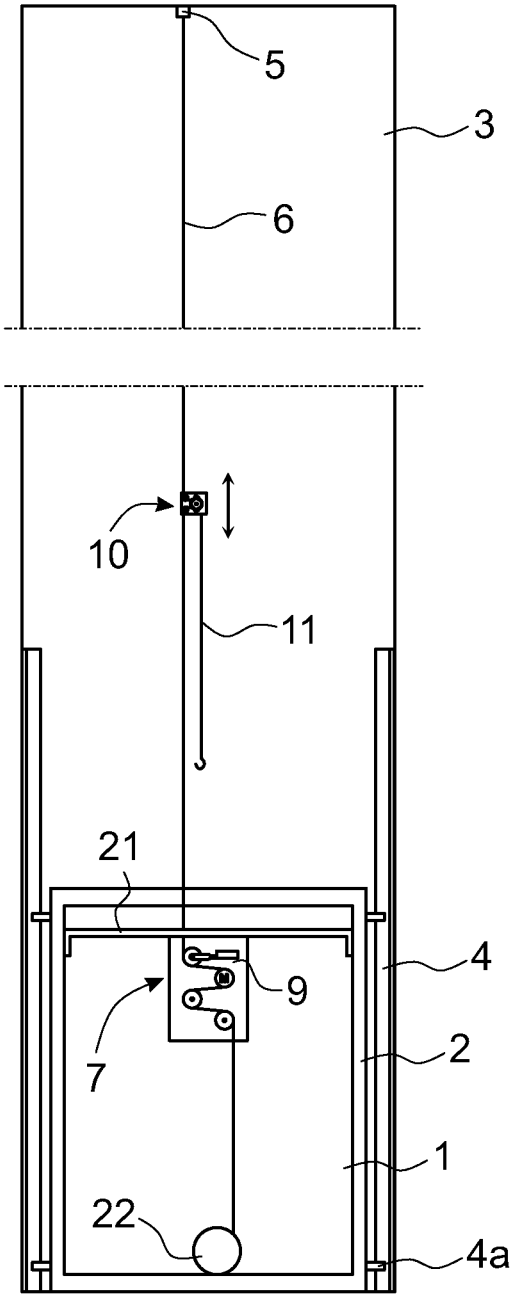

In the following, the invention will be described in greater detail by the aid of some examples of its embodiment with reference to the attached drawings, wherein FIG. 1 presents a diagrammatic and simplified side view of one embodiment of the installation arrangement, according to the invention, for an elevator, FIG. 2 presents a simplified and magnified side view of the embodiment of FIG. 1, FIG. 3 presents a side view of one auxiliary hoist belonging to the installation arrangement, according to the invention, for an elevator, FIG. 4 presents a simplified and sectioned front view of the auxiliary hoist according to FIG. 3, FIG. 5 presents a simplified front view of a second auxiliary hoist belonging to the installation arrangement, according to the invention, for an elevator, said hoist being connected to a suspension member, FIG. 6 presents a simplified front view of an auxiliary hoist according to FIG. 5, when connecting it to a suspension member or detaching it therefrom, FIG. 7 presents a simplified front view of a third auxiliary hoist belonging to the installation arrangement, according to the invention, of an elevator, said hoist being connected to a suspension member, and FIG. 8 presents a side view of one alternative embodiment of an installation arrangement, according to the invention, for an elevator.

FIG. 1 presents a diagrammatic and simplified view of an elevator hoistway 3, in which an elevator is installed. The elevator car 1 has been assembled inside the car sling 2 on the base of the elevator hoistway 3. The first, i.e. lowermost, sections of the guide rails 4 of the elevator are fixed to the walls of the hoistway 3 and the elevator car 1 is fitted onto these starting ends of the guide rails 4 by means of guide shoes 4*a*. The suspension member 6 is fixed at its first end to a fixing point in the top part of the elevator hoistway 3, which suspension member in this embodiment is a toothed belt, the teeth on the surface of which belt that transmit kinetic energy being e.g. inclined in two directions, essentially V-shaped, and either open or solid from the tips. The suspension member 6 extends from the top part of the hoistway 3 to the bottom part of the hoistway, and an installation hoist 7 is fitted to the suspension member 6, above the elevator car 1, which installation hoist is fixed to the top part of the elevator car 1 or of the car sling 2 by means of a fixing means 8, such as a rope or chain. The installation hoist 7 comprises a hoisting machine 9, by means of which the installation hoist 7 is arranged to move upwards and downwards on the suspension member 6 along the suspension member 6 simultaneously carrying along with it the elevator car 1 in the hoistway 3.

An auxiliary hoist 10 is fitted onto the same suspension member 6 above the installation hoist 7, which auxiliary hoist has a hoisting machine provided with its own traction sheave, which hoisting machine is arranged to move the auxiliary hoist 10 on the suspension member 6 upwards and downwards along the suspension member 6. The toothing of the suspension member 6 and the grooving of the traction sheave of the auxiliary hoist 10 corresponding to it form a good grip, as a result of which the suspension member 6 is not able to slip on the traction sheave of the auxiliary hoist 10, which enables the use of this type of auxiliary hoist 10. The auxiliary hoist 10 also comprises a hoisting means 11, which is e.g. a chain provided with a lifting hook, the length of which chain can be adjusted by means of the use of the links of the chain. Also different lengths of hoisting means 11 can be used, which are used according to the need at the time. The auxiliary hoist 10 is arranged to lift parts of the elevator, such as sections of the guide rails, into their positions. The parts of the elevator to be installed are e.g. arranged to be carried upwards in the hoistway along with the elevator car 1, after which they are lifted into their positions by means of the auxiliary hoist 10 and fixed into their positions. The auxiliary hoist 10 functions in such a way that it is moved on the suspension member 6 downwards to a height that is suitable for getting the hook of the hoisting means 11 fastened to the object to be lifted. After this the auxiliary hoist 10 is moved upwards on the suspension member 6, in which case it simultaneously lifts the object fastened to the hoisting means 11 upwards.

FIG. 2 presents a diagrammatic, simplified and magnified view of the installation arrangement for an elevator presented above. The installation hoist 7 is composed of a casing 12, as well as of a hoisting machine 9 with traction sheave 9*a*, diverting pulleys 13*a*, 13*b* and 13*c* and a tensioning means 14 that are inside it, and also of a fixing means 8 fixed to the bottom part of the casing 12, via which fixing means the installation hoist 7 is connected to the elevator car 1. The suspension member 6 is arranged to travel from the fixing point 5 in the top part of the hoistway downwards to the installation hoist 7 and from the top end of the casing 12 of the hoist to inside the casing 12, where it is arranged to pass around the bottom of the first diverting pulley 13*a* to the traction sheave 9*a* of the hoisting machine 9. The traction sheave 9*a* of the hoisting machine 9 is provided with grooving corresponding to the toothing of the suspension member 6. The suspension member 6 is arranged to pass around the traction sheave 9*a* and from the traction sheave 9*a* the suspension member 6 is led to pass around the second diverting pulley 13*b*, after which over the third diverting pulley 13*c* and out of the casing to the side of the elevator car 1 towards the bottom part of the elevator hoistway 3.

The tensioning means 14 is e.g. a gas spring and it is arranged to push the first diverting pulley 13*a* in such a way that the suspension member 6 remains sufficiently taut. In addition, around the traction sheave 9*a* are fitted jump guards, which are arranged to prevent the suspension member 6 from jumping off the traction sheave 9*a*. The jump guards are not drawn in FIG. 2.

An auxiliary hoist 10 is fitted to the suspension member 6 above the installation hoist 7, which auxiliary hoist comprises the chain-type hoisting means 11 mentioned earlier. In the situation of the figure, the auxiliary hoist 10 has been driven to such a height that the hook of the lifting means 11 is slightly below the top edge of the elevator car 1, in which case parts of the elevator that are on the side of the elevator car 1 could be fastened to the hook. In addition, a current conductor 15 and also control means 16, by means of which the auxiliary hoist 10 is arranged to be moved along the suspension member 6 upwards and downwards in relation to the installation hoist 7, are connected to the auxiliary hoist 10.

FIG. 3 presents a side view and FIG. 4 a sectioned front view of one auxiliary hoist 10 belonging to the installation arrangement, according to the invention, of an elevator. On the bottom edge of the auxiliary hoist 10 is e.g. a hook 11*a*, to which the top end of a chain-type hoisting means 11 of the auxiliary hoist 10 can be fixed. The auxiliary hoist 10 is composed of two frame pieces 17*a* and 17*b*, of a motor 18 fixed to the first frame piece 17*a*, and also of a traction sheave 19 and two diverting pulleys 20*a* and 20*b* fitted onto their shafts between the frame pieces. FIG. 4 is sectioned at the point of the inside edge of the second frame piece 17*b*, in which case the second frame piece 17*b* is not visible in FIG. 4.

The suspension member 6 is arranged to pass below the first diverting pulley 20*a* to the traction sheave 19 and to pass round the rear of the traction sheave 19 over the second diverting pulley 20*b*, after which the suspension member 6 is again led downwards. In the traction sheave 19 are essentially V-shaped grooves 19*a*, the shape, size and interspacing from each other of which of which correspond to the toothing of the suspension member 6 and to the grooving of the surface of the traction sheave 9*a* of the installation hoist 7. Jump guards of a corresponding type to those on the installation hoist 7 are fitted around the traction sheave 19, which jump guards are not, however, drawn in FIG. 4.

FIG. 5 presents a simplified front view of an auxiliary hoist 10, according to a second embodiment, belonging to the installation arrangement, according to the invention, of an elevator, said hoist being connected to a suspension member 6 of the elevator car 1. In this attitude the auxiliary hoist 10 can be driven on the suspension member 6 upwards and downwards along the suspension member. In the auxiliary hoist 10 presented by FIG. 4, a strong structure and bearings are needed in order for the auxiliary hoist with its bearings to withstand the force effect exerted by the elevator car 1 on the suspension member 6 and the rest of the load to be lifted along with the elevator car. On the other hand, the structure, shafts and bearings of the auxiliary hoist 10 in the solution according to FIG. 5 can be smaller because the suspension member 6 does not exert as large a force effect on the structure as e.g. in the structure according to FIG. 4.

Presented in the auxiliary hoist 10 according to FIG. 5 are mainly only the traction sheave 23 and the presser unit 24, comprising presser rolls 25*a* and 25*b*, which are arranged to press the suspension member 6 from the essentially smooth rear side of the suspension member against the rim of the traction sheave 23. The pressing occurs e.g. by means of a spring force or by means of an electrical or other force means suited to the purpose. On the rim of the traction sheave 23 are e.g. essentially similar V-shaped grooves 19*a* as presented in FIG. 3, the shape, size and interspacing from each other of which grooves correspond to the toothing of the suspension member 6 and to the grooving of the surface of the traction sheave 9*a* of the installation hoist 7. A jump guard 26 is disposed between the presser rolls 25*a* and 25*b* to prevent detachment of the suspension member 6 from the rim of the traction sheave 23.

FIG. 6 presents an auxiliary hoist 10 according to FIG. 5 in a situation in which the auxiliary hoist 10 has just been detached from the suspension member 6 or it is just being connected to the suspension member 6. The auxiliary hoist 10 comprises means for increasing and for decreasing the distance between the traction sheave 23 and the presser rolls 25*a*, 25*b* of the presser unit 24. When the distance is large enough a gap-like space 27 forms between the traction sheave 23 and the presser unit 24, in which gap the suspension member 6 can be freely detached from both the traction sheave 23 and from the presser rolls 25*a*, 25*b*. In this attitude the auxiliary hoist 10 can easily be connected to the suspension member 6 and detached from it. The connecting takes place e.g. in such a way that the auxiliary hoist 10 is pushed from the side of the suspension member 6 onto a point of the suspension member 6 in such a way that the suspension member 6 remains in the gap-like space 27 between the traction sheave 23 and the presser rolls 25*a*, 25*b* of the presser unit 24, after which the gap-like space 27 is closed by pressing the presser rolls 25*a*, 25*b* against the traction sheave 23 e.g. with the same means with which the gap-like space was also opened. The opening and closing of the gap-like means 27 can preferably be performed with the same means with which the actual compression of the suspension member 6 against the traction sheave 23 is implemented when the auxiliary hoist 10 is driven upwards and downwards along the suspension member 6.

FIG. 7 presents a simplified front view of an auxiliary hoist 10, according to a third embodiment, belonging to the installation arrangement, according to the invention, of an elevator, said hoist being connected to a suspension member 6 of the elevator car 1. In this attitude the auxiliary hoist 10 can be driven on the suspension member 6 upwards and downwards along the suspension member. In the solution according to FIG. 7 the suspension member 6 is a chain, but the suspension member 6 could just as well be a toothed belt, in which the transmission of force is based on shape-locking. The auxiliary hoist 10 has a frame 28, in which is a chain wheel functioning as a traction sheave 29 mounted on bearings allowing rotation, an electric motor 18 fixed to the frame 28 being arranged to rotate said chain wheel. In addition, in the frame 28 is a chain wheel functioning as a detent wheel 30 mounted on bearings allowing rotation, which with respect to the traction sheave 29 is on the other side of the suspension member 6. Preferably the traction sheave 29 is higher up than the detent wheel 30, but the wheels can also be the other way round.

At the point of the shaft of the traction sheave 29 on the second side of the suspension member 6 is a jump guard 31, which is arranged to move in a groove 32 by means of its actuator means towards the suspension member 6 and the traction sheave 29 and away from them. In FIG. 7 the closest position of the jump guard 31 to the suspension member 6 is presented with an unbroken line and the position in which the jump guard 31 is farthest from the suspension member 6 with a dot-and-dash line. In a normal operating situation the jump guard 31 does not touch the suspension member 6 otherwise than to prevent the suspension member 6 from jumping off the traction sheave 29.

When placing the auxiliary hoist 10 into its position on the suspension member 6 the jump guard is in its farthest position from the traction sheave 29 as described with a dot-and-dash line. In this case when the auxiliary hoist 10 is suitably inclined, e.g. in FIG. 7 counterclockwise, a gap-like space remains between the traction sheave 29 and the detent wheel 30, in which the suspension member 6 can be freely detached from both the traction sheave 29 and from the detent wheel 30. In this attitude the auxiliary hoist 10 can easily be connected to the suspension member 6 and detached from it. The connecting takes place e.g. in such a way that the auxiliary hoist 10 is pushed from the side of the suspension member 6 onto a point of the suspension member 6 in such a way that the suspension member 6 goes into the gap-like space between the traction sheave 29 and the detent wheel 30, after which the gap-like space is closed by turning the auxiliary hoist 10 counterclockwise, or by letting it turn counterclockwise under its own weight, and by displacing the jump guard 31 into its proximity position beside the suspension member 6. Now the auxiliary hoist 10 is ready for use.

As stated above, in the solution according to FIG. 7 the suspension member 6 is a chain, in which case there is a chain wheel as the traction sheave 29 in the auxiliary hoist 10, which chain wheel is configured to press against the chain from the first side of the chain. In addition, in the auxiliary hoist 10 below the traction sheave 29 is a chain wheel as a detent wheel 30, which chain wheel is configured to press against the chain from the second side of the chain. When the fixing hook 11*a* of the hosting means 11 of the auxiliary hoist 10 is disposed farther from the chain functioning as the suspension member 6 of the elevator car and on the same side of the chain as the detent wheel 30 that is lower down than the traction sheave 29, a load fixed to the hoisting means 11 of the auxiliary hoist 10 causes torque that tries to turn the auxiliary hoist clockwise in FIG. 7 and at the same time presses the chain wheel functioning as the traction sheave 29 against the suspension member 6. In this case the traction sheave 29 is configured, in respect of its outer rim, to correspond to the part transmitting the kinetic energy of the chain that is the suspension member 6 and the detent wheel 30 keeps the auxiliary hoist 10 in balance. Owing to the structure of the auxiliary hoist 10, the torque exerted by the load is sufficient to keep the traction sheave 29 sufficiently tightly against the suspension member 6 and the auxiliary hoist 10 can be driven safely upwards and downwards along the suspension member 6.

FIG. 8 presents a side view of a second embodiment of an installation arrangement, according to the invention, of an elevator. In this solution the installation hoist 7 is fitted inside the elevator car 1, in which case more space remains on the roof of the elevator car 1 for performing installation work. In the roof of the elevator car 1 is an aperture, from which the suspension member 6 is led to inside the elevator car and the installation hoist 7 is fixed e.g. to the walls of the elevator car with a fixing means 21. Additionally, in the elevator car 1 is a reel 22, onto which the suspension member 6 is arranged to be reeled when the elevator car is lifted upwards. An auxiliary hoist 10 is fitted onto the suspension member 6 above the elevator car 1 in the same way as in the first embodiment described above.

It is obvious to the person skilled in the art that different embodiments of the invention are not only limited to the examples described above, but that they may be varied within the scope of the claims presented below. Thus, for example, the installation hoist can be different than in the embodiments described above. The installation hoist can be e.g. a corresponding type to the auxiliary hoist described above, however one suited in its structure and in its hoisting power for moving the elevator car.

It is also obvious to the person skilled in the art that the suspension member can be of another type than a toothed belt with V-shaped teeth. The toothing of the suspension member can be e.g. transverse and straight, transverse and curved, inclined in one direction or some other suitable shape. The suspension member can also be a V-shaped belt in its cross-sectional profile, in which case the surfaces transmitting kinetic energy are at an angle with respect to each other. The suspension member can also be of some other suitable shape in its cross-sectional profile. In all cases the grooving of the traction sheaves must be made to correspond to the belt.

It is also obvious to the person skilled in the art that the auxiliary hoist can be structurally and functionally different than what is presented in the preceding by means of the three embodiments.

The invention claimed is:

1. An installation arrangement for an elevator in an elevator hoistway, the installation arrangement comprising:

at least a suspension member suspended downwards from a top of the elevator hoistway;

an installation hoist configured to perform a first movement to move in the elevator hoistway along the suspension member while supported by the suspension member above an elevator car, the installation hoist configured to hoist at least the elevator car traveling on guide rails in the elevator hoistway in response to the first movement of the installation hoist along the suspension member; and an auxiliary hoist including a hoisting member supported by the suspension member between a roof of the elevator hoistway and the installation hoist such that the auxiliary hoist is above the elevator car, the auxiliary hoist configured to perform a second movement to move reciprocally in the elevator hoistway along the suspension member independently of the first movement of the installation hoist along the suspension member.

2. The installation arrangement according to claim 1, wherein a first traction sheave associated with the installation hoist is configured to rotationally move to perform the first movement to move the installation hoist along the suspension member, and a second traction sheave associated with the auxiliary hoist is configured to rotationally move to perform the second movement to move the auxiliary hoist along the suspension member such that the installation hoist and the auxiliary hoist move along a same suspension member.

3. The installation arrangement according to claim 2, wherein a cross-section of the suspension member is V-shaped on a contact surface on the first traction sheave and the second traction sheave.

4. The installation arrangement according to claim 2, wherein outer rims of the first traction sheave and the second traction sheave are configured to correspond to the suspension member.

5. The installation arrangement according to claim 1, wherein the suspension member is a toothed belt having teeth thereon.

6. The installation arrangement according to claim 5, wherein the teeth are one of (i) transverse and straight; (ii) transverse and curved; (iii) inclined in one direction; (iv) inclined in two directions; and (v) V-shaped.

7. The Installation arrangement according to claim 1, wherein the auxiliary hoist is configured to move on the suspension member in relation to the installation hoist.

8. The Installation arrangement according to claim 1, wherein the hoisting member of the auxiliary hoist is adjustable in length or is replaceable.

9. The installation arrangement of claim 1, wherein the auxiliary hoist is configured to selectively disconnect from the suspension member by sliding the auxiliary hoist in a direction perpendicular to a length of the suspension member when there is a sufficient gap between a traction sheave associated with the auxiliary hoist and the suspension member.

10. The installation arrangement of claim 1, wherein the suspension member is configured to attach to a fixing point on the roof of the elevator hoistway.

11. An auxiliary hoist comprising:

a motor configured to perform a first movement to move the auxiliary hoist in an elevator hoistway along a toothed belt, the toothed belt configured to support an installation hoist attached thereto below the auxiliary hoist in the elevator hoistway such that the auxiliary hoist is above an elevator car between a roof of the elevator hoistway and the installation hoist, the installation hoist configured to perform a second movement to move in the elevator hoistway along the toothed belt to move an elevator car along a first section of guide rails installed in the elevator hoistway such that the auxiliary hoist is configured to perform the first movement along the toothed belt independently of the second movement of the installation hoist along the toothed belt; and a hoisting member connected to a frame of the auxiliary hoist, the hoisting member configured to lift a second section of the guide rails within the elevator hoistway.

12. The auxiliary hoist of claim 11, further comprising:

a traction sheave having V-shaped grooves therein corresponding to teeth of the toothed belt.

13. The auxiliary hoist of claim 11, wherein the auxiliary hoist is configured to selectively disconnect from the toothed belt by sliding the auxiliary hoist in a direction perpendicular to a length of the toothed belt when there is a sufficient gap between a traction sheave associated with the auxiliary hoist and the toothed belt.

14. The auxiliary hoist of claim 11, further comprising:

a controller configured to instruct the motor to move the auxiliary hoist along the toothed belt.

15. The auxiliary hoist of claim 11, wherein the installation hoist is installed one of above the elevator car or inside the elevator car.

16. The auxiliary hoist of claim 11, wherein, the auxiliary hoist is configured to hoist the second section of the guide rails within the elevator hoistway without locking the elevator car and detaching the toothed belt from the elevator car.

17. An auxiliary hoist comprising:

a motor configured to move the auxiliary hoist along a toothed belt, the toothed belt configured to support an installation hoist attached thereto between the auxiliary hoist and an elevator car in an elevator hoistway, the installation hoist configured to move the elevator car along a first section of guide rails installed in the elevator hoistway; and a hoisting member connected to a frame of the auxiliary hoist, the hoisting member configured to lift a second section of the guide rails within the elevator hoistway, wherein an end of the toothed belt is configured to attach to a fixing point on the roof of the elevator hoistway.

* * * * *